US006966871B2

(12) United States Patent
Parmater

(10) Patent No.: US 6,966,871 B2
(45) Date of Patent: Nov. 22, 2005

(54) MULTIFUNCTION EXERCISE DEVICE

(75) Inventor: Kim Parmater, Minnetonka, MN (US)

(73) Assignee: Parmater Productions Inc., Hopkins, MN (US)

( * ) Notice: Subject to any disclaimer, the term of this patent is extended or adjusted under 35 U.S.C. 154(b) by 291 days.

(21) Appl. No.: 10/098,605

(22) Filed: Mar. 14, 2002

(65) Prior Publication Data

US 2003/0176263 A1 Sep. 18, 2003

(51) Int. Cl.[7] ..... A63B 26/00; A63B 71/00
(52) U.S. Cl. ..... 482/140; 482/130; 482/129; 482/142
(58) Field of Search ..... 482/142, 140, 482/907, 908, 72, 92, 93, 95, 96, 99, 100, 482/101, 114, 121–133, 148

(56) References Cited

U.S. PATENT DOCUMENTS 4,494,662 A * 1/1985 Clymer ..... 482/123
4,625,963 A * 12/1986 Lancellotti ..... 482/130
4,754,964 A * 7/1988 Michaels ..... 482/112
5,620,403 A * 4/1997 Lundin ..... 482/96
5,690,594 A * 11/1997 Mankovitz ..... 482/121
5,700,232 A * 12/1997 Clausen et al. ..... 482/125
5,752,901 A * 5/1998 Lee ..... 482/130
5,759,137 A * 6/1998 Huang ..... 482/72
5,868,654 A * 2/1999 Norian ..... 482/140
6,220,995 B1 * 4/2001 Chen ..... 482/140
6,371,895 B1 * 4/2002 Endelman et al. ..... 482/135
6,527,685 B2 * 3/2003 Endelman et al. ..... 482/121
6,616,580 B1 * 9/2003 Chen ..... 482/123
2002/0058573 A1 * 5/2002 Endelman et al. ..... 482/142
2003/0032534 A1 * 2/2003 McAfee, Jr. ..... 482/133

* cited by examiner

*Primary Examiner*—Gregory L. Huson
*Assistant Examiner*—L. Amerson
(74) *Attorney, Agent, or Firm*—Brouse McDowell; Heather M. Barnes

(57) ABSTRACT

A home exercise device is of greater value when it is capable of multiple functions and can be easily stored when not in use. Lightweight springs are used in place of heavy weight plates to reduce shipping costs and simplify storage. The device also includes a frame that supports a base, providing linear movement of the base relative to the frame. A bar, with spring tension, is coupled to a multi-position lock. This allows the bar to be positioned in a variety of locations relative to the frame and the user, thereby providing a variety of exercises. A head portion is also provided that includes a torsion spring. This spring can be engaged or disengaged from the frame to allow the user to provide spring tension to resist movement of the head portion. The diversity of movable components offers a vast variety of exercises that can be performed on the unit as well as enabling the unit to fold down for storage when not in use.

6 Claims, 5 Drawing Sheets

MULTIFUNCTION EXERCISE DEVICE

FIELD OF THE INVENTION

The present invention generally relates to devices for performing physical exercise. More specifically, the present invention relates to space efficient exercise devices that are capable of multiple exercise function.

BACKGROUND OF THE INVENTION

As our society becomes more technologically advanced, our bodies are faced with fewer physical demands. To maintain a healthy lifestyle, our physical bodies require stress in the form of resistance training and cardiovascular training. In the interest of efficiency, products have To been created for the intended purpose of use in the home. This accommodates busy lifestyles in that the user can save travel time to a health club or gym by exercising at home. Since most homes are not made to include a gym, space is of a premium. Therefore, devices that provide a multitude of exercises in a single unit and are able to fold away for storage when not in use are greatly desirable. Spring resistance can be advantageous when used on such a device because weight plates, which are heavy to move and inexpensive to ship can be replaced with this lightweight mode of energy storage. The larger muscles of the body, such as the hip and leg extensors are preferably utilized on such a piece of home exercise equipment. Doing so not only allows strength training of these valuable muscle groups, but at low resistance the repeated movement for a prolonged period of time (over 15 minutes) can provide a very effective form of cardiovascular exercise.

SUMMARY OF THE INVENTION

In one aspect, of the invention features an exercise device including a frame, and a base adapted for linear motion and supported by the frame. A multi-position lock is mounted to the frame, the lock enabling a plurality of secure angular orientations relative to the frame. A bar is adapted to couple to the multi-position lock and a head portion is pivotally mounted to the frame. The frame includes a spring that is releasably coupled to the frame thereby, when engaged the spring allows resistance to movement of the head portion.

The system may also include the frame and the base being adapted for linear motion by use of, in combination, a male tube and a female tube that telescope relative to one another. The multi-position lock may be comprised of a first portion that is releasably secured to a second portion, the first portion mounted to the frame and the second portion adapted to receive the bar.

The bar is preferably further comprised of a free end, a handle and a flexible portion. The flexible portion is preferably comprised of a coil spring that is mounted between the free end and the handle.

The head portion preferably includes a head frame mounted to a head support and the head frame is mounted to the spring. The spring may be comprised of a torsion spring that is releasably coupled to the frame by way of a locking pin and a spring ear. This can be accomplished by the locking pin being movably mounted to the frame and the spring ear being mounted to the spring. The base may also include at least one wheel capable of articulation on a supportive surface.

BRIEF DESCRIPTION OF THE DRAWINGS

The foregoing and other objects of this invention, the various features thereof, as well as the invention itself, may be more fully understood from the following description, when read together with the accompanying drawings, as described.

For the most part, and as will be apparent when referring to the figures, when an item is used unchanged in more than one figure, it is identified by the same alphanumeric reference indicator in all figures.

DETAILED DESCRIPTION OF THE PREFERRED EMBODIMENT

Figure 1:
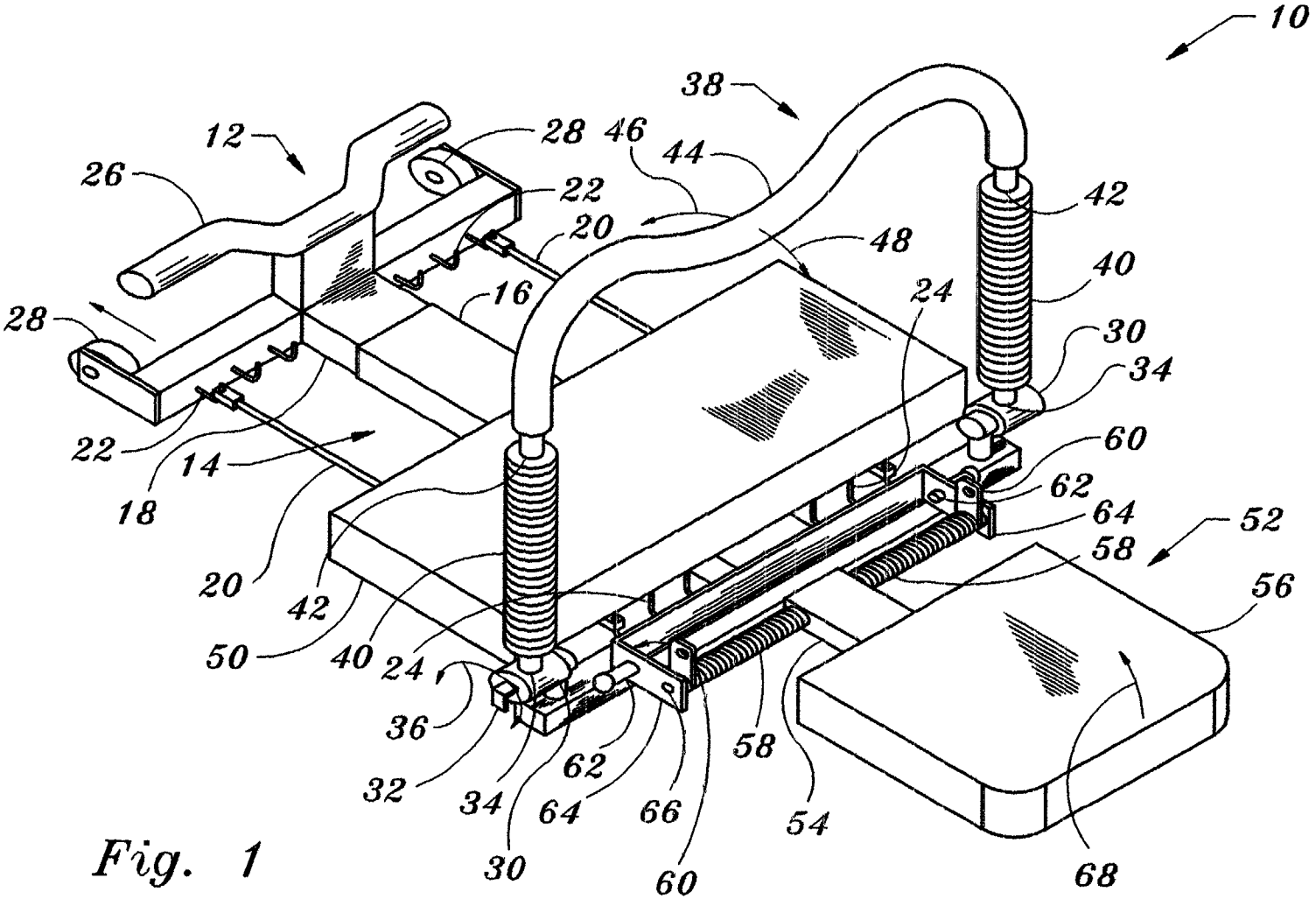
FIG. 1 is an isometric view of an assembled multifunction exercise device produced in accordance with the present invention.

The present invention is an exercise device that includes multiple components that are adjustable to provide a great variety of exercise variation in a single unit. In FIG. 1, the device 10 includes a base 12 that provides linear movement relative to the frame 14. This can be accomplished in a variety of ways but the most cost efficient is by use of telescoping tubes, in this case a female tube 16 as part of the frame 14 and a male tube 18 as part of the base 12. Variation to these elements and specifics of the components are not considered critical to the novelty of the invention and therefore variations can exist. The given combination allows linear movement and tracking of the base 12 relative to the frame 14 with minimal number of parts.

Resistance to movement of the base 12 relative to the frame 14 can be provided by tensions cords 20. These cords 20 can vary in individual tension and number of cords used. Only two cords 20 are shown in this figure, but there could be as many as six in that the cords are suspended between the base hooks 22 and the frame hooks 24. In the preferred embodiment there are six base hooks 22 and six frame hooks 24, but this number can vary as needed to supply more tension or to limit the tension capability of the device 10.

The base 12 is shown here to include a handle 26. This can be used to support the feet of a user or the hands of a user, depending upon the orientation of the user relative to the device 10. A pair of wheels 28 are also mounted to the base 12. This allows the base 12 to move over a supportive surface with minimal drag or friction. Friction in a piece of exercise equipment is in many cases undesirable. Friction causes wear, which prematurely shortens the useful life of the device. More importantly, friction is a non-conserved energy. This means that the user's force production during the concentric phase (muscle shortening) of movement is the resistance plus the friction. During the eccentric phase (muscle lengthening) of movement the resistance the user feels is the resistance applied by the device minus the force of friction. The muscles of the body are always stronger during the eccentric phase as compared to the concentric phase; therefore a device with excessive friction exacerbates this inherent difference and thereby reduces the effectiveness of the exercise device. Therefore friction reducing elements such as rolling friction wheels and simplistic guidance and tracking systems can be desirable.

The frame includes a pair of movable locks 30. These locks 30 can be released and engaged by articulating the lock tab 32. When released, the holes 34 can be rotated to different angular orientations, as depicted by the arrow 36. A bar 38, which includes free ends that are received by the holes 34 in the locks 30 are then capable of being positioned in an infinite number of angular orientations relative to the frame 14. The locks 30 are intended to set the starting position of the bar 38 in this, the preferred embodiment. A pair of springs 40 are included in the structure of the bar 38. The bar post 42 does not extend through the spring 40, thus allowing a front to rear resistance to movement of force applied to the bar handle 44 by flexion of the spring 40 that is then countered by the frame 14 by way of the locks 30. This movement is illustrated by the front arrow 46 and rear arrow 48. A seat pad 50 is positioned adjacent to the locks 30 to aid in supporting the user during operation of the device 10.

Another unique feature of the invention 10 is found in the head portion 52. The head portion 52 includes a head frame 54 that supports a head support 56. This frame 54 is a structural member that, in the preferred embodiment, is a piece of steel tubing, but is not limited to any particular material or form. The structural integrity of the frame 54 is evident not only in its ability to support the head support 56, but a torsion spring 58 is attached to each side of the support 54. The springs 58 are attached to spring ears 60 which are releasably engaged with the pin 62. The spring 58 is generally supported by a mandrel that is mounted to the head ears 64 by way of a hole 66. This allows the spring 58 and entire head portion 52 to be pivotally mounted to the frame 14. By engaging the spring ears 60 with the pin 62, the torsion springs 58 offer resistance to movement of the head portion 52 by the user. Movement of the head portion 52 is depicted by the arrow 68. The head portion 52 would typically go through such a movement to engage the ears 60 with the pins 62.

It is to be understood that the use of the term "torsion spring" applies to any spring that is capable of applying a torsional load. This can be an extension spring, a leaf spring or any other form that can provide torsional bias between the head frame 54 and the head ears 60. The term "torsion spring" is intended to be descriptive and not limiting to the scope of the invention.

Figure 2:
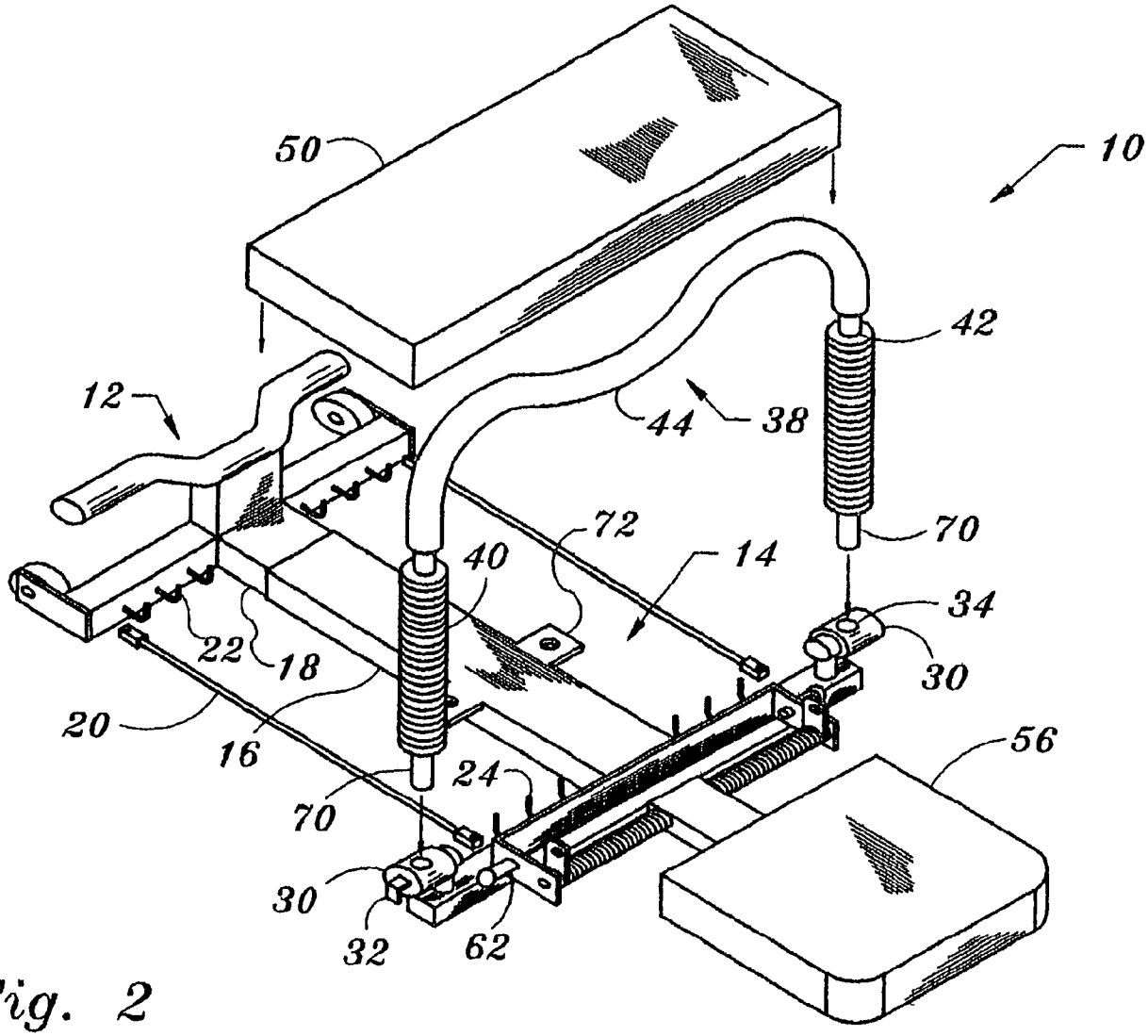
FIG. 2 is an exploded isometric view of a multifunction exercise device produced in accordance with the present invention.

In FIG. 2, the seat pad 50 and the bar 38 have been removed to better show the detail of the device 10. The bar 38 includes a pair of free ends 70 which are received by the holes 34. There are a variety of methods of attachment of these parts together, but the inventor has found that simple friction between the mating parts is sufficient to hold the bar 38 in the locks 30 due to the orthogonal forces that are inherently applied during the front to rear flexion during the exercises. If an additional clamping force was needed, the free ends 70 could be fitted with a contour or ridge that is received by the internal structure of the lock 30. The lock 30 could also be fitted with a friction lock that not only locks to the frame 14, but clamps down on the free end 70 of the bar 38 through manipulation of the lock tab 32. Frame ears 72 can be used to support the seat pad 50, but are not critical to the novelty of the invention. Any of a variety of forms of attachment can be used as long as it does not interfere with the tracking of the base 12 with the frame 14.

Figure 3:
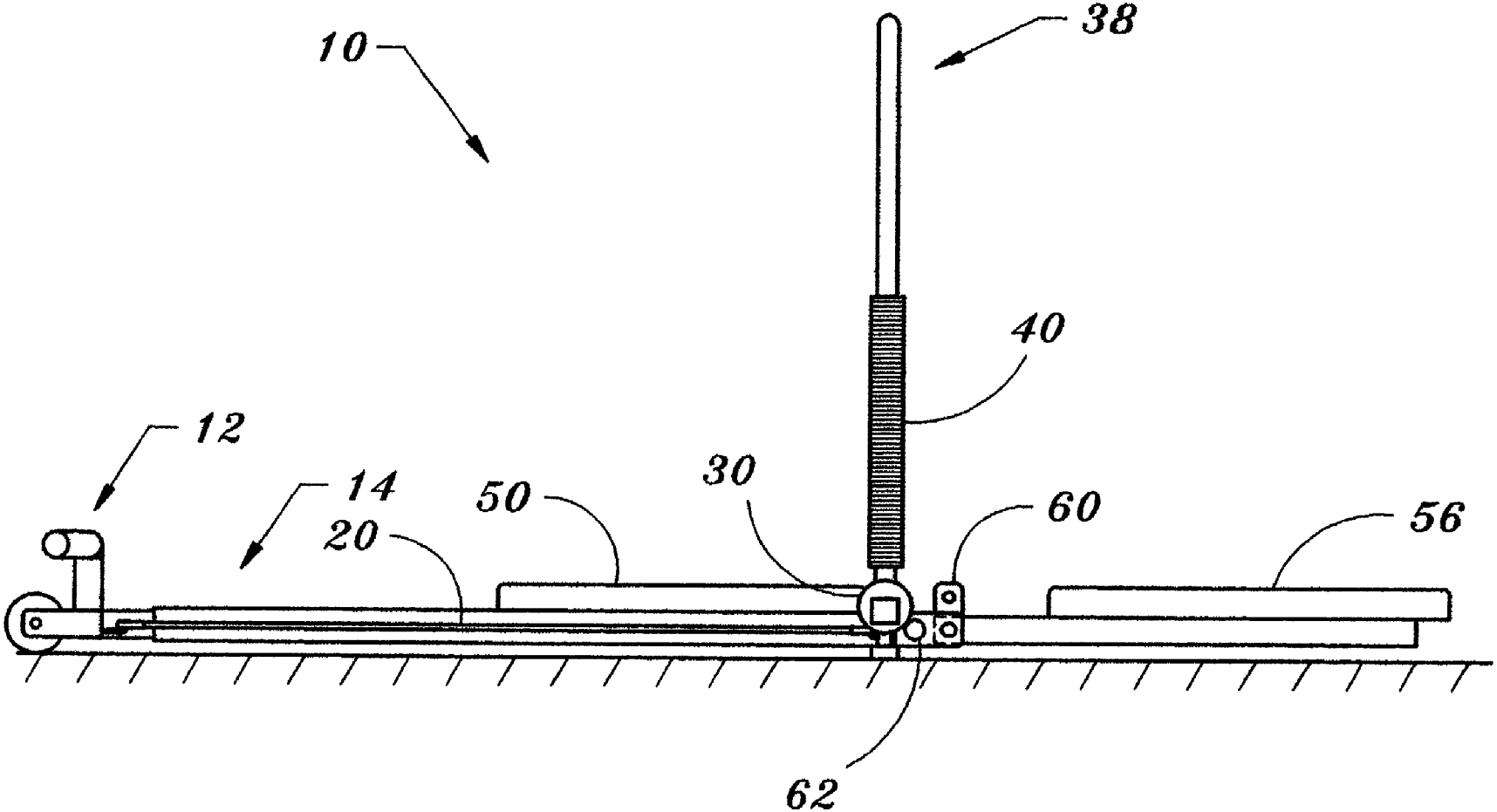
FIG. 3 is a side view of an assembled multifunction exercise device in a single position, the device produced in accordance with the present invention.

A side view of the device 10 is shown in FIG. 3. Here the unit is in a fully extended position with the bar 38 set perpendicular to the frame 14 by virtue of the lock 30. The spring ears 60 are disengaged from the pin 62. The base 12 is retracted within the frame 14 by the tension applied from the tension cords 20. The device 10 is set in one position that is ready for a user to perform a variety of exercises.

Figure 4:
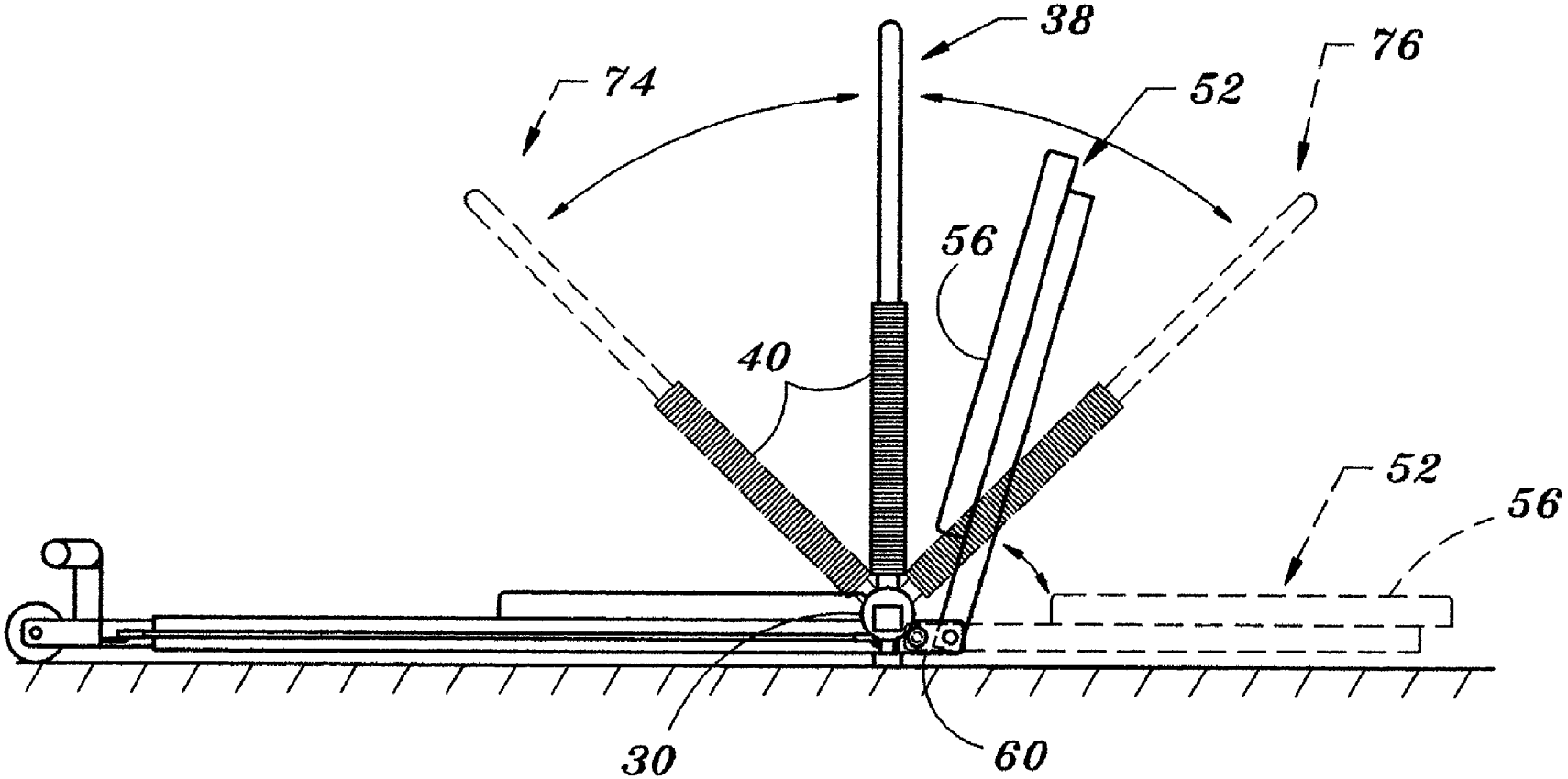
FIG. 4 is a side view of an assembled multifunction exercise device showing multiple starting positions of the back and bar, the device produced in accordance with the present invention.

A variation of the previous is shown in FIG. 4. Here the bar 38 is shown in a vertical position, in a position rotated forward 74 and one rotated to the rear 76. It is to be noted that the springs 40 on the bars 38 are not deformed, therefore the displacement of the bar 38 to the various positions is done by movement of the lock 30, not through movement during the exercise. The head portion is also shown in two positions. The dashed line shows the head portion 52 in a down position similar to if the torsion spring (as disclosed previously) were disengaged from the frame. In the upper position (solid lines) the head portion is almost vertical. The weight of the head portion 52 will cause some deformation of the torsion spring and would naturally position the head portion 52 in a position similar to that shown. The lower position (dashed lines) would be achieved by the user pushing against the head portion 38 to displace it to this lower position against the tension of the torsion spring. This is further illustrated in the following figure.

Figure 5:
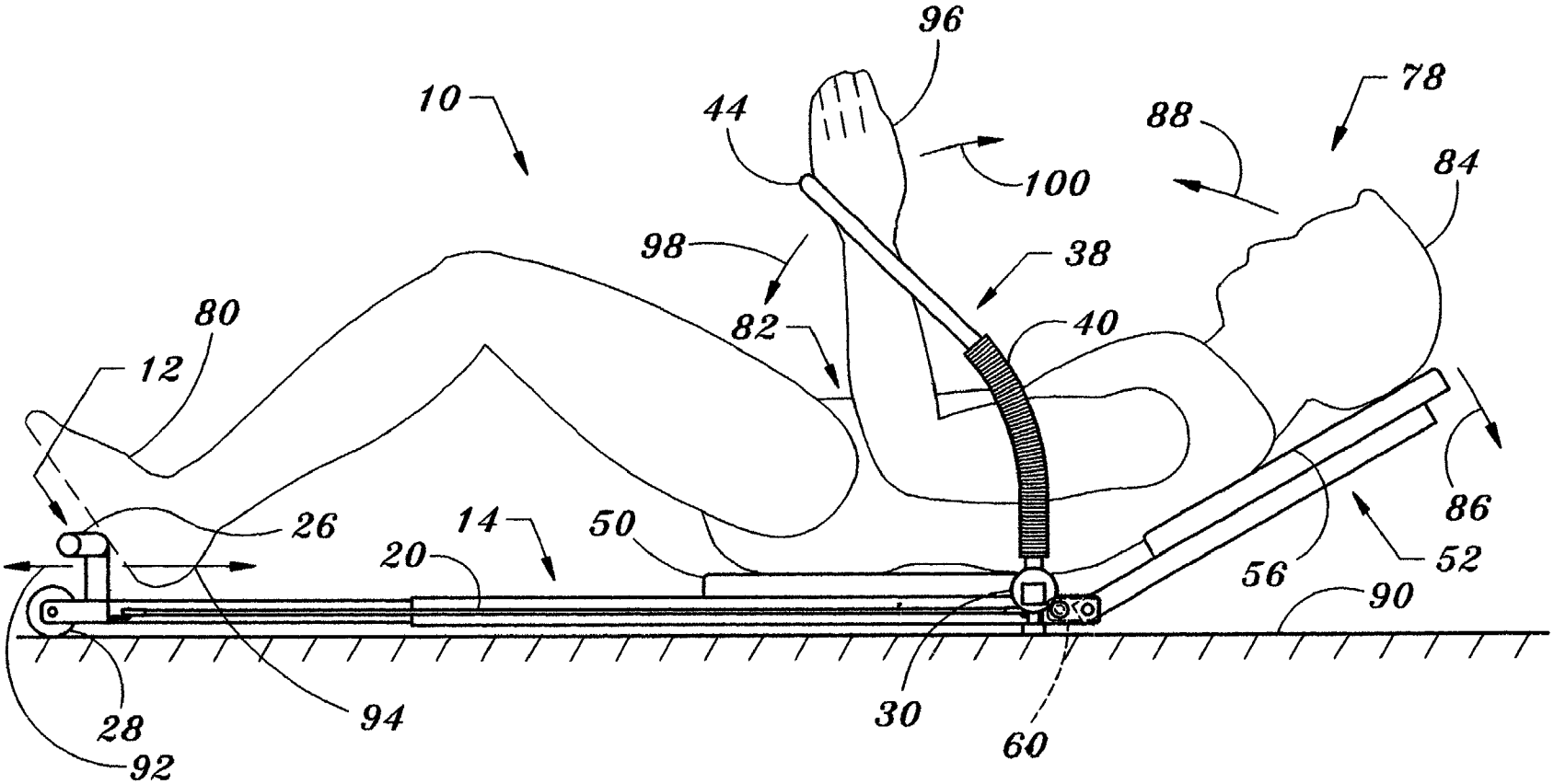
FIG. 5 is a side view of an assembled multifunction exercise device shown as it could be used, the device produced in accordance with the present invention.

A sample exercise is shown in FIG. 5. This is only one example of a virtually endless list of exercises that can be performed on the device 10. It is understood that this is only one example of the versatility of device 10. The user 78 is positioned supine on the device 10 with feet 80 against the base 12, lower torso 82 on the seat pad 50 and head 84 and shoulders on the head support 56 of the head portion 52. With the spring ear 60 locked to the frame, the head portion 56 offers resistance to movement down as depicted by the down arrow 86. The upward movement of the upper body of the user 78, as depicted by the up arrow 88, is either assisted by the torsion spring or completely provided by the torsion of that spring, depending upon the tension of the spring used. If the tension is great enough, the user will push the head portion 56 down and the spring will push the user up again. If the spring provides less tension, the weight of the upper body of the user may be greater than the spring's tension capability. In this case, the resistance provided by the torsion spring acting on the head portion 52 of the device 10 will simply assist the user in performing a sit-up. This is done by supplementing the trunk flexor muscles by "removing" a portion of the user's affective upper bodyweight by virtue of tension in the spring.

A second part of the exercise is in the leg\hip extension movement that takes place by pressing the user's 78 feet 80 against the handle 26 of the base 12. The wheels 28 are supported on the floor 90, or other supportive surface, as the base 12 extends away from the frame 14. This movement is illustrated by the forward arrow 92. The return movement (rear arrow 94) offers an eccentric action to the extensor muscles of the hips and legs of the user 78, as well as recoils the device 10 to prepare for another repetition. This eccentric action, concentric resistance and recoil is due to the tension cords 20 which draw the base 12 toward the frame 14. As previously disclosed, these cords 20 can vary in tension and number of cords to alter the resistance to meet the individual training needs of the user 78.

The upper body component of this exercise is provided by the bar 38. The bar handle 44 makes direct contact with the hands 96 of the user 78. The bar 38 is locked into place by the lock 30. As force is applied to the bar handle 44 the spring 44 deforms in an inferior direction as depicted by the inferior arrow 98. The elastic properties of the spring 40 offer resistance to deformation and require the user 78 to resist movement back to an upright or neutral position. This movement is shown by the superior arrow 100. This provides a concentric and an eccentric action for the arm, chest and shoulder muscles of the user 78.

It is understood that this is only one example of the use and embodiment of the invention as seen by the inventor. This version is shown in that it is considered by the inventor to be the preferred embodiment, though many details as disclosed are not intended to be considered limiting.

What is claimed is:

1. An exercise device comprising:

a frame including a substantially longitudinal portion and a plurality of hooks;

a base adapted for linear motion and supported by said substantially longitudinal portion of said frame; said base further including a handle and a plurality of hooks;

a pair of moveable locks engageable by articulating a lock tab, each of said locks is comprised of a first portion releasably secured to a second portion, the first portion mounted to said frame and said second portion adapted to receive a bar whereby when released, the bar is adapted to rotate in an infinite number of angular orientations relative to the frame; said bar having a free end, a flexible portion and a handle operatively connected to said frame; and a head portion comprising a head frame mounted to a head support, said head portion being pivotally mounted to said frame and including a spring releasably coupled to said frame thereby, when engaged said spring allows resistance to movement of said head portion, wherein said longitudinal portion of said frame and said base adapted for linear motion are in combination comprised of a male and a female tube that telescope relative to one another; said head frame is mounted to said spring; a plurality of cords suspended between said base and said frame.

2. The exercise device as in claim 1, wherein said flexible portion is comprised of a pair of coil springs that are mounted between said free end and said handle.

3. The exercise device as in claim 2, wherein said spring is comprised of a torsion spring.

4. The exercise device as in claim 1, wherein said spring is releasably coupled to said frame by way of a locking pin and a spring ear.

5. The exercise device as in claim 4, wherein said locking pin is movably mounted to said frame and said spring ear is mounted to said spring.

6. The exercise device as in claim 1, wherein said base includes at least one wheel adapted for movement on a supportive surface.

* * * * *